US005111246A

United States Patent [19]

Brailsford et al.

[11] Patent Number: 5,111,246

[45] Date of Patent: May 5, 1992

[54] ELECTROSTATOGRAPHIC MACHINE

[75] Inventors: Ian Brailsford; Robert A. Carter, both of Stevenage, United Kingdom; Edward J. Gutman, Webster; Don B. Jugle, Renfield, both of N.Y.; Roger D. Masham, Ashwell, United Kingdom

[73] Assignee: Xerox Corporation, Stamford, Conn.

[21] Appl. No.: 621,683

[22] Filed: Dec. 3, 1990

[30] Foreign Application Priority Data

Feb. 20, 1990 [GB] United Kingdom ..... 9003747

[51] Int. Cl.[5] ..... G03G 15/06

[52] U.S. Cl. ..... 355/245; 361/212

[58] Field of Search ..... 355/245, 251, 259, 215, 355/210; 361/212

[56] References Cited

U.S. PATENT DOCUMENTS

| | | | |
|---|---|---|---|
| 3,682,538 | 8/1972 | Cade et al. | 355/215 |
| 3,816,799 | 6/1974 | Ott et al. | 355/296 X |
| 3,863,603 | 2/1975 | Buckley et al. | 355/251 X |
| 3,985,436 | 10/1976 | Tanaka et al. | 355/200 |
| 3,991,713 | 11/1976 | Whited | 118/637 |
| 4,168,901 | 9/1979 | Ito et al. | 355/251 |
| 4,231,319 | 11/1980 | Waibel et al. | 361/212 X |
| 4,387,982 | 6/1983 | Stanley | 355/215 |
| 4,400,081 | 8/1983 | Yamashita et al. | 361/212 X |
| 4,580,888 | 4/1986 | Thompson et al. | 355/215 |
| 4,697,914 | 10/1987 | Hauser | 355/215 |
| 4,766,455 | 8/1988 | Carter | 355/212 |
| 4,796,057 | 1/1989 | Howard et al. | 355/215 X |

FOREIGN PATENT DOCUMENTS 1582797 1/1981 Japan .

*Primary Examiner*—A. T. Grimley
*Assistant Examiner*—Nestor R. Ramirez

[57] ABSTRACT

An electrostatographic printer has a process unit adapted to be removably mounted in a main assembly of an electrostatographic reproducing machine, the process unit including a developement apparatus at which an electrostatic latent image is developed on an imaging member, and a transfer device which causes a developed toner image to be transferred from the moving imaging member to a copy sheet. The development apparatus is contained within a housing of an electrically insulating material, and comprises conductive means adjacent the exit portion of the development apparatus, i.e. the portion from which the imaging member emerges as it moves towards the transfer device. The conductive means includes a conductive coating on the exit portion of the developer housing, and a conductive seal member through which an electrical discharge path is provided. This reduces the tendency of debris to accumulate in the region of the exit portion, and prevents any debris which does accumulate from building up a charge (which would have detrimental effects on the developed image).

2 Claims, 3 Drawing Sheets

ELECTROSTATOGRAPHIC MACHINE

CROSS REFERENCE TO RELATED APPLICATION

Reference is made to commonly assigned copending application Ser. No. 07/621,674 filed concurrently herewith in the name of Newbury and entitled Fiber Traps in Electrostatographic Machines.

BACKGROUND OF THE INVENTION

This invention relates to an electrostatographic reproducing machine, particularly but not exclusively a xerographic copier, including a development apparatus at which an electrostatic latent image is developed on an imaging member, and a transfer device which causes a developed toner image to be transferred from the moving imaging member to a copy sheet.

Conventionally, in the automatic xerographic process, a latent electrostatic image of an original to be reproduced is recorded upon an image retaining member and the image then made visible, or developed, by means of a finely divided particulate toner material. In reusable xerography, the developed toner image is generally transferred from the image retaining member to a copy sheet, such as paper or the like, and the image affixed thereto to form a permanent record of the original input scene information. Although a preponderance of the toner material comprising the developed image is transferred to the copy sheet, a small amount of residual toner is nevertheless invariably left behind on the image retaining member surface after the transfer operation. In order to restore the image retaining member to conditions suitable for reuse, the residual toner must be cleaned or removed from the image retaining member surface, for example by means of an elastomeric blade cleaner, before a new imaging cycle is instituted. Generally, the residual toner is collected in a chamber where it may either be stored for later disposal or recirculated for further use.

Recently there has been a move in the xerographic art towards including the photoreceptor together with other process means such as a charge corotron, a developement device, a transfer corotron and a cleaning device in a process unit in the form of a cassette. An example of such a cassette is described in U.S. Pat. No. 3,985,436. The use of a cassette of this kind enables the easy replacement of those parts of the xerographic machine which are most likely to deteriorate with use, especially the photoreceptor, but also the development and cleaning systems as well as the corotron wires.

A xerographic cassette of this kind is preferably made of low cost materials, so that it can be disposed of at the end of its useful life. Such a cassette typically has a housing made of a molded plastics material, which is usually electrically insulating. This is generally convenient because it enables the various components in the cassette, including the electrical components, to be electrically isolated from one another without the need for additional insulating elements.

A problem may arise however, because of the tendency of debris particles to become electrically charged and to accumulate in the development apparatus, especially at or around the exit of the development apparatus. The debris typically includes toner particles and agglomerates from the developer housing, as well as paper fibers and small paper pieces. In the case of paper, paper fibers may be scrubbed or dislodged from the surface by the mechanism which feeds and advances copy paper sheets towards the transfer station, for example a friction retard system paper feeder frequently used in xerographic copiers. Despite the use of a fibre trap in addition to the main (blade) cleaner, some paper debris usually finds its way into the developer housing, either by migrating backwards (i.e. in the direction opposite the direction of movement of the photoreceptor) from the transfer station, or, in the case where cleaned-off toner is recirculated, by being cleaned off the photoreceptor with the toner and recirculated to the development apparatus. The insulating housing inhibits discharge of the charged debris, so the charge may be retained for long periods of time, especially in conditions of low ambient humidity. The build-up of charge in this way gives rise to the problem that unwanted charges may transfer to the photoreceptor, causing random marks or spots to be developed out in the final image.

PRIOR ART

U.S. Pat. No. 4,697,914 to Hauser discloses a nulling electrode 70 located at the exit portion of a developer housing 34 that minimizes the deposition of charged toner particles in the background areas of a photoconductor. Electrode 70 forms a strong electric field against the surface of a photoconductor 76 that repels charged toner particles from the exit zone of the toner housing, thus preventing them from entering back into and contaminating the development zone. See col. 8, lines 5–44 and FIG. 4.

U.S. Pat. No. 4,387,982 to Stanley dicloses an electrophotographic printing machine that uses an electrically charged plate 80 located adjacent to a developer housing 54 that collects scattered toner particles emanating from a development system 20. See col. 6, lines 15–64 and FIG. 2.

SUMMARY OF THE INVENTION

The present invention is intended to overcome this problem, and provides an electrostatographic reproducing machine including a development apparatus in which an electrostatic latent image is developed on an imaging member, and a transfer device which causes a developed toner image to be transferred from the moving imaging member to a copy sheet, the development apparatus being contained within a housing of an electrically insulating material, and comprising conductive means adjacent the portion of the development apparatus from which the imaging member emerges as it moves towards the transfer device.

In accordance with a further aspect of the present invention, there is provided a process unit adapted to be removably mounted in a main assembly of an electrostatographic reproducing machine, the process unit including a development apparatus in which an electrostatic latent image is developed on an imaging member, and a transfer device which causes a developed toner image to be transferred from the moving imaging member to a copy sheet, the development apparatus being contained within a housing of an electrically insulating material, and comprising conductive means adjacent the portion of the development apparatus from which the imaging member emerges as it moves towards the transfer device.

BRIEF DESCRIPTION OF THE DRAWINGS

An embodiment of the invention will now be described, by way of example, with reference to the accompanying drawings, in which.

DETAILED DESCRIPTION OF THE INVENTION

Figure 1:
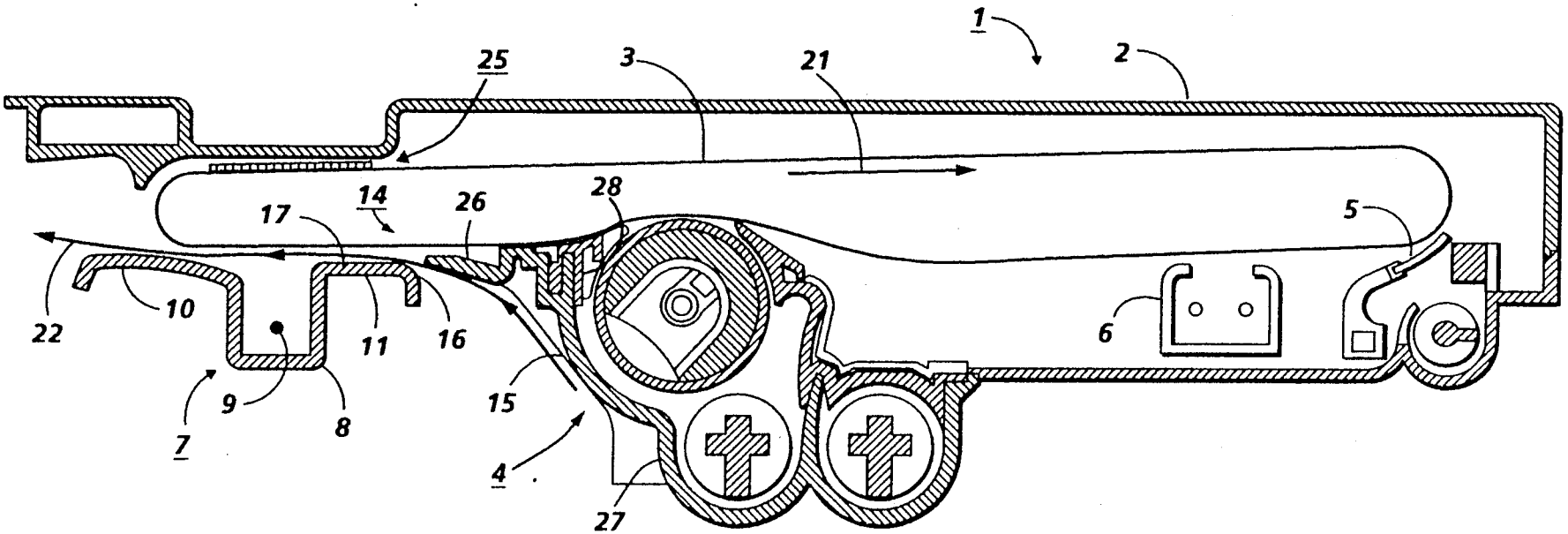
FIG. 1 is a schematic cross section of a process unit including a conductive seal member in accordance with the invention.

The process unit or cassette 1 shown in FIG. 1 is designed to be removably mounted in the main assembly of a xerographic copier as described, for example, in the aforementioned U.S. patent and in U.S. Pat. No. 4,766,455 to which reference is invited for further details. The cassette 1 comprises a housing 2 made for example, primarily of polystyrene, which encloses an imaging member in the form of a belt photoreceptor 3 in addition to various process means, in particular a development device 4, a cleaner blade 5, and a charge corotron 6. These processing means are not directly relevant to the subject matter of the present invention and so no further details are given here except to note that a retractable cleaner blade suitable for this application is the subject of U.S. Pat. No. 4,796,057. The belt photoreceptor is an endless flexible belt having a photosensitive surface. In the arrangement shown, when the cassette 1 is removed from the main assembly of the copier the belt is only loosely retained in the cassette but when the cassette is inserted into the main assembly of the copying machine, the photoreceptor belt is tensioned and supported in an operative position as shown. A cassette having this kind of loosely retained photoreceptor which is tensioned automatically on insertion into the main assembly of the copier forms the subject of our aforementioned U.S. Pat. No. 4,766,455. In operation, the photoreceptor 3 moves in an endless path in the direction of arrow 21.

A transfer charging device 7 is included in the cassette housing in the vicinity of the photoreceptor belt 3 at the area where a toner image is to be transferred from the belt to a copy sheet. The technique of actually transferring a toner image is well known to those skilled in the art and no further details need be given here. The transfer charging device is in the form of a corotron having an outer shield 8 which, as is conventional, is substantially U-shaped and made, for example, of stainless steel. A corona wire 9 extends the full length of the shield 8 and is spaced apart from the walls thereof in the usual manner.

At its upper end the shield has extended portions 10 and 11 on its left and right-hand sides respectively, as viewed in the drawing. These portions 10 and 11 act as guide members and define the path which a copy sheet follows as it passes through the transfer zone of the cassette for the purposes of having a toner image transferred thereto. An aperture 14 is present between the right-hand extension 11 of corotron shield 8 and the main part of the cassette housing to enable the copy sheet to enter the process unit. The aperture 14 is in the form of a slot extending substantially the full width of the cassette and is relatively narrow, for example, 2 mm wide. Thus the slot is sufficiently wide to permit a copy sheet to enter the cassette but narrow enough to provide appreciable protection for the photoreceptor from damage, contamination, and light exposure, thus prolonging the useful life of the photoreceptor.

The path which a copy sheet follows as it passes through the cassette for image transfer purposes is denoted by arrow 22 in FIG. 1. The external wall portion 15 of the main part of the cassette housing is shaped so as to deflect and guide the approaching copy sheets towards the aperture 14. Furthermore, the extreme right-hand side of the extended portion 11 of corotron shield 8 has a downturned lip 16 inclined obtusely relative to the adjacent plateau portion 17. The downturned lip 16 thus also acts to guide approaching copy sheets towards the aperture 14.

As the copy sheet enters the cassette it follows the path defined between the photoreceptor belt 3 and the plateau portion 17 of the corotron shield extension 11 which thus acts as a paper guide.

The belt photoreceptor 3 moves in the direction of arrow 21 and as it does so any paper fibers which have gathered on its surface during image transfer are collected on the upstream side of a velour fabric fiber trap 25 to prevent them being conveyed to the cleaner blade 5. As mentioned above, however, some paper fibers have a tendency to migrate from the region of the paper guide and the transfer station, in the direction opposite to the direction of movement of the photoreceptor belt 3, and find their way to the exit portion 26 of the part 27 of the cassette which forms a housing for the development apparatus. The exit portion 26 is that portion of the housing of the development apparatus from which the photoreceptor emerges as it moves towards the transfer device. Other debris which tends to accumulate at the exit portion 26 of the developer housing 27 includes toner particles and toner particle agglomerates ejected from the development apparatus.

In the apparatus of the invention, this tendency of debris to collect between the development apparatus and the transfer device 7, especially on exit portion 26 of the developer housing, is much reduced, if not eliminated, by making the exit portion 26 conductive. This may be done by, for example, coating the exit portion 26 with a conductive material such as a carbon doped paint. Alternatively a conductive plastics or metallic strip or tape may be secured over the exit portion 26.

Figure 2:
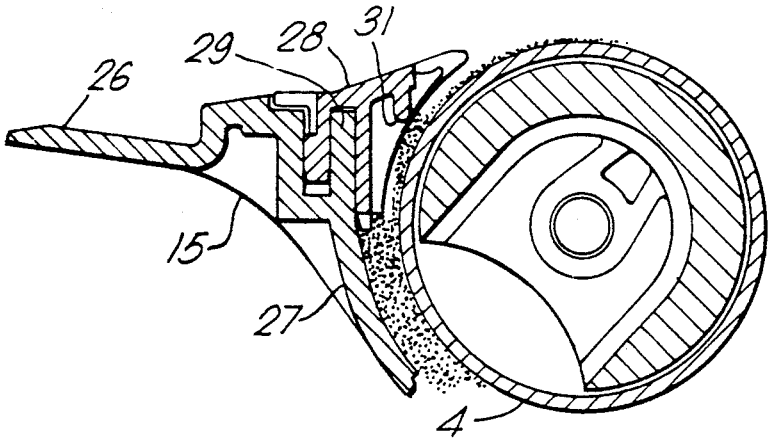
FIG. 2 is an enlarged cross sectional view of part of the process unit of FIG. 1.
Figure 3:
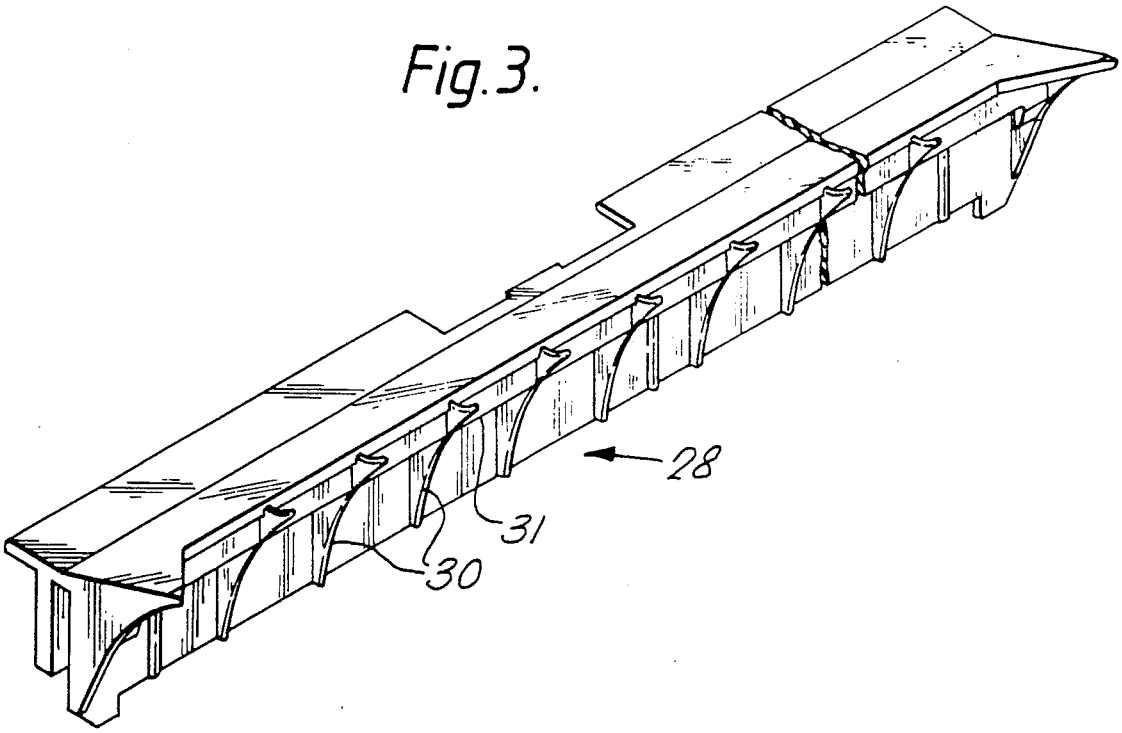
FIG. 3 is a perspective view of the conductive seal member.

A conductive path to allow charges to be dissipated from the exit portion 26 is provided by a seal member 28 which is conveniently made of a conductive plastics material. Conductive seal 28 (FIGS. 2 and 3) may be in the form of a conductive plastics moulding, and clips over an upstanding lip 29 that is formed in the developer housing 27. The seal is of the configuration shown in the drawings, being shaped in cross-section so as to substantially fill the converging region of the developer housing adjacent the exit region 26, and having a plurality of generally vertical ribs 30 to help reduce sideways movement of the developer material during shipment of the cassette. The seal 28 is shaped and positioned to fit close to the developer roll 4, so that it acts as a seal to prevent loss of developer particles if the cassette is inverted during handling outside the copying machine. A 'valve' effect is produced by the location of a strong magnetic pole within the developer roll 4 adjacent the point 31 of closest approach of the seal 28 to the developer roll. A concentration of magnetic carrier particles in this region provides a seal when the developer roll is stationary, but allows passage of developer during operation. Suitable materials for the conductive seal 28 include carbon-filled plastics materials or metallic materials.

By providing the whole of the exit portion 26 of the developer housing 27, including the lip 29, with a conductive coating, an electrically conductive discharge path is established from the exit portion, to the seal 28 and thence through the developer material to earth via the developer roll 4. Alternatively, the discharge path may be provided by grounding the seal 28 directly, through wires, metallic strips or conductive tracks connected to earthed components.

This discharge path from the exit portion 26 acts both to prevent accumulation of debris in the first place, and to discharge such small amounts of debris as might accumulate, thereby preventing unwanted charges from transferring to the photoreceptor.

Figure 4:
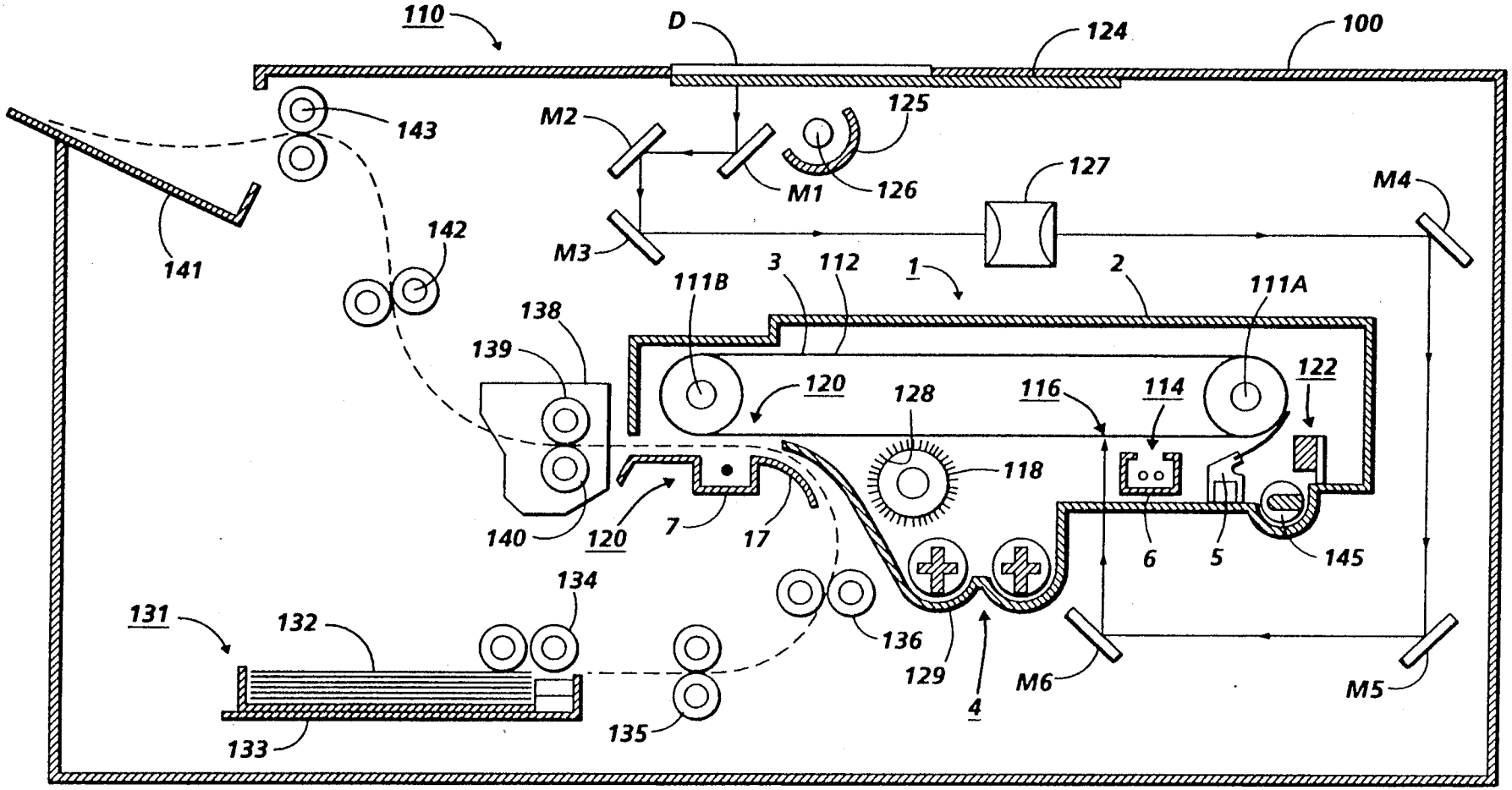
FIG. 4 is a schematic view in cross section of a reproducing machine having a cassette according to the invention.

Referring now to FIG. 4, there is shown schematically a xerographic printing machine 110 having the removable process unit 1 of the present invention in its operational position in the main assembly 100. The machine includes an endless flexible photoreceptor belt 1 mounted for rotation in the clockwise direction as shown about support rollers 111*a* and 111*b* to carry the photosensitive imaging surface 112 of the belt 3 sequentially through a series of xerographic processing stations, namely a charging station 114, an imaging station 116, a development station 118, a transfer station 120, and a cleaning station 122.

The charging station 114 comprises a corotron 6 which deposits a uniform electrostatic charge on the photoreceptor belt 3. The photoreceptor belt 3, the charge corotron 6, the developer device 4, the transfer corotron 7, and the blade cleaner 5 may all be incorporated in a process cassette 1 adapted to be removably mounted in the main assembly 100 of the xerographic copier as described in U.S. Pat. No. 4,766,455. An original document D to be reproduced is positioned on a platen 124 and is illuminated in known manner a narrow strip at a time by a light source comprising a tungsten halogen lamp 126. Light from the lamp is concentrated by an elliptical reflector 125 to cast a narrow strip of light on to the side of the original document D facing the platen 124. Document D thus exposed is imaged on to the photoreceptor 1 via a system of mirrors M1 to M6 and a focusing lens 127. The optical image selectively discharges the photoreceptor in image configuration, whereby an electrostatic latent image of the original document is laid down on the belt surface at imaging station 116. In order to copy the whole original document the lamp 126, the reflector 125, and mirror M1 are mounted on a full rate carriage (not shown) which travels laterally at a given speed directly below the platen and thereby scans the whole document. Because of the folded optical path the mirrors M2 and M3 are mounted on another carriage (not shown) which travels laterally at half the speed of the full rate carriage in order to maintain the optical path constant. The photoreceptor 1 is also in motion whereby the image is laid down strip by strip to reproduce the whole of the original document as an image on the photoreceptor.

By varying the speed of the scan carriages relative to the photoreceptor belt 1 it is possible to alter the size of the image along the length of the belt, i.e. in the scanning direction. In full size copying, that is to say with unity magnification, the speed of the full rate carriage and the speed of the photoreceptor belt are equal. Increasing the speed of the scan carriage makes the image shorter, i.e. reduction, and decreasing the speed of the scan carriage makes the image longer, i.e. magnification.

The image size can also be varied in the direction orthogonal to the scan direction by moving the lens 127 along its optical axis closer to the original document i.e. closer to mirrors M2 and M3, for magnification greater than unity, and away from the mirrors M2 and M3 for reduction, i.e. magnification less than unity. When the lens 127 is moved, the length of the optical path between the lens and the photoreceptor, i.e. the image distance, is also varied by moving mirrors M4 and M5 in unison to ensure that the image is properly focused on the photoreceptor 1. For this purpose mirrors M4 and M5 are suitably mounted on a further carriage (not shown).

At the development station 118, a magnetic brush developer device with a developer roll 128 develops the electrostatic latent image into visible form. Here, toner is dispensed from a hopper (not shown) into developer housing 129 which contains a two-component developer mixture comprising a magnetically attractable carrier and the toner, which is deposited on the charged area of belt 1 by a developer roll 128.

The developed image is transferred at transfer station 120 from the belt to a sheet of copy paper according to the practice of the present invention. The copy paper is delivered into contact with the belt in synchronous relation to the image from a paper supply system 131 in which a stack of paper copy sheets 132 is stored on a tray 133. The top sheet of the stack in the tray is brought, as reqired, into feeding engagement with a top sheet separator/feeder 134. Sheet feeder 134 feeds the top copy sheet of the stack towards the photoreceptor around a 180° path via two sets of nip roll pairs 135 and 136. The path followed by the copy sheets through the aperture in the cassette is denoted by a broken line. At the transfer station 120 transfer corotron 7 provides the electric field to assist in the transfer of the toner particles thereto.

The copy sheet bearing the developed image is then stripped from the belt 1 and subsequently conveyed to a fusing station 138 which comprises a heated roll fuser 139 to which release oil may be applied in known manner. The image is fixed to the copy sheet by the heat and pressure in the nip between the two rolls 139 and 140 of the fuser. The final copy is fed by the fuser rolls into catch tray 141 via two further nip roll pairs 142 and 143.

After transfer of the developed image from the belt some toner particles usually remain on the surface of the belt, and these are removed at the cleaning station 122 by a cleaner blade 5 which scrapes residual toner from the belt. The toner particles thus removed fall into a receptacle 145 below. Also, any electrostatic charges remaining on the belt are discharged by exposure to an erase lamp 146 which provides an even distribution of light across the photoreceptor surface. The photoreceptor is then ready to be charged again by the charging corotron 6 as the first step in the next copy cycle.

The patents and applications referred to herein are hereby specifically and totally incorporated herein by reference.

From the foregoing it will be evident that various modifications may be made within the scope of the present invention.

While the invention has been illustrated with respect to copying apparatus it will be understood that it may be used in printer apparatus where a light beam such as a laser beam may be used to selectively discharge portions of the photoconductor. All such modifications and embodiments as may readily occur to the artisan are intended to be within the scope of the appended claims.

We claim:

1. A process unit adapted to be removably mounted in a main assembly of an electrostatographic printing machine, the process unit comprising a housing of an electrically insulating plastics material, an imaging member mounted for movement within the housing, a development apparatus within the housing containing developer material for developing an electrostatic latent image on the imaging member, and a transfer device mounted on the housing which causes a developed image to be transferred from the moving imaging member to a copy sheet, the development apparatus including a conductive exit portion over which the imaging member passes as it moves towards the transfer device and which forms a seal for the developer material in the development apparatus, the conductive exit portion extending over the whole region from the development apparatus to the transfer device, thereby providing an electrical discharge path from the exit portion and preventing unwanted charge from building up on the exit portion.

2. A process unit according to claim 11 wherein said discharge path is provided through the developer material within the development apparatus.

* * * * *